US009803381B1

(12) United States Patent
Bailie

(10) Patent No.: US 9,803,381 B1
(45) Date of Patent: Oct. 31, 2017

(54) RAMP AND/OR PLATFORM ASSEMBLY

(71) Applicant: Homecare Products, Inc., Algona, WA (US)

(72) Inventor: David A. Bailie, Kent, WA (US)

(73) Assignee: Homecare Products, Inc., Algona, WA (US)

( * ) Notice: Subject to any disclaimer, the term of this patent is extended or adjusted under 35 U.S.C. 154(b) by 0 days.

(21) Appl. No.: 13/789,286

(22) Filed: Mar. 7, 2013

(51) Int. Cl.

| | |
|---|---|
| ***E04G 7/24*** | (2006.01) |
| ***E04G 5/06*** | (2006.01) |
| ***E04G 7/08*** | (2006.01) |
| ***E04G 7/20*** | (2006.01) |
| *E04F 11/18* | (2006.01) |
| *E04F 11/00* | (2006.01) |

(52) U.S. Cl.
CPC ..... *E04G 7/24* (2013.01); *E04G 5/06* (2013.01); *E04G 7/08* (2013.01); *E04G 7/20* (2013.01); *E04F 11/002* (2013.01); *E04F 11/18* (2013.01)

(58) Field of Classification Search
CPC .... E04G 5/06; E04G 7/08; E04G 7/10; E04G 7/20; E04G 7/22; E04G 7/24; E04C 5/165; Y10T 403/70; Y10T 403/7129; Y10T 403/7141
USPC ..... 182/113, 178.1–178.6, 222, 223; 403/306; 405/221
See application file for complete search history.

(56) References Cited

U.S. PATENT DOCUMENTS

| | | | | | |
|---|---|---|---|---|---|
| 1,345,012 | A | * | 6/1920 | Jones | 403/396 |
| 1,358,951 | A | * | 11/1920 | Helmich | 405/221 |
| 1,555,847 | A | * | 10/1925 | Hudson | 403/306 |
| 1,588,810 | A | * | 6/1926 | Rudolph et al. | 403/310 |
| 1,716,904 | A | * | 6/1929 | Siderits | 403/396 |
| 2,169,102 | A | * | 8/1939 | Lemont | 403/389 |
| 2,335,046 | A | * | 11/1943 | Droeger | 182/119 |
| 2,483,341 | A | * | 9/1949 | Haas | 403/293 |
| 2,571,337 | A | * | 10/1951 | Burnham | 405/218 |
| 2,620,839 | A | * | 12/1952 | Tyler | 269/89 |
| 2,676,044 | A | * | 4/1954 | Gorman et al. | 403/346 |
| 3,053,930 | A | * | 9/1962 | Mallanik et al. | 174/94 R |
| 3,065,010 | A | * | 11/1962 | Scheneman | 403/218 |
| 3,074,241 | A | * | 1/1963 | Cahill et al. | 405/2 |
| 3,079,186 | A | * | 2/1963 | Williams | 403/274 |
| 3,208,227 | A | * | 9/1965 | Armbrust | 405/221 |
| 3,462,021 | A | * | 8/1969 | Hawke et al. | 211/182 |
| 3,677,582 | A | * | 7/1972 | Flick | 403/391 |
| 3,693,754 | A | * | 9/1972 | Butler | 182/86 |
| 3,808,757 | A | * | 5/1974 | Greenwood | 52/184 |
| 3,891,052 | A | * | 6/1975 | Lee et al. | 182/88 |
| 4,074,537 | A | * | 2/1978 | Gronlie | 405/218 |
| 4,092,079 | A | * | 5/1978 | Swanson | 403/306 |
| 4,263,984 | A | * | 4/1981 | Masuda et al. | 182/113 |
| 4,314,771 | A | * | 2/1982 | Lambert | 403/305 |

(Continued)

FOREIGN PATENT DOCUMENTS

| | | | | |
|---|---|---|---|---|
| FR | 1245325 | A | * 11/1960 | A63H 33/107 |

*Primary Examiner* — Colleen M Chavchavadze

(74) *Attorney, Agent, or Firm* — Christenson O'Connor Johnson Kindness PLLC

(57) ABSTRACT

A support assembly suitable for use in a modular ramp and platform assembly is disclosed. Additionally, an interface between components of the platform assembly, including, for example, the interface between the ramp section and the deck or platform section is provided, and may include support flanges that operatively interact with one or more slots positioned on the platform section.

9 Claims, 5 Drawing Sheets

(56) References Cited

U.S. PATENT DOCUMENTS

| | | | | | |
|---|---|---|---|---|---|
| 4,362,423 | A * | 12/1982 | Miles | 403/393 |
| 4,617,775 | A * | 10/1986 | Padrun | 52/684 |
| 4,734,062 | A * | 3/1988 | Goto | H01R 4/5083 439/781 |
| 4,759,162 | A * | 7/1988 | Wyse | 52/126.6 |
| 4,776,726 | A * | 10/1988 | Viles | 405/221 |
| 5,326,337 | A * | 7/1994 | Pardella | 482/36 |
| 5,370,560 | A * | 12/1994 | Ito | H01R 4/188 174/94 R |
| 5,409,122 | A * | 4/1995 | Lazarus | 211/186 |
| 5,584,606 | A * | 12/1996 | Hoogasian, Jr. | 405/221 |
| 5,653,459 | A * | 8/1997 | Murphy | 280/166 |
| 6,116,437 | A * | 9/2000 | Rowe | 211/189 |
| 6,217,259 | B1 * | 4/2001 | Godbersen | 405/218 |
| 6,585,207 | B2 * | 7/2003 | Ibbitson et al. | 248/229.2 |
| 6,810,995 | B2 * | 11/2004 | Warford | 182/115 |
| 7,241,078 | B2 * | 7/2007 | Surges | 405/220 |
| 8,028,494 | B2 * | 10/2011 | Denn et al. | 52/848 |
| 8,272,184 | B2 * | 9/2012 | Cech | 52/677 |
| 2011/0188984 | A1 * | 8/2011 | Hofer | 414/802 |
| 2011/0198153 | A1 * | 8/2011 | Dufour et al. | 182/113 |
| 2011/0262219 | A1 * | 10/2011 | Van Walraven | F16B 7/18 403/341 |

* cited by examiner

RAMP AND/OR PLATFORM ASSEMBLY

BACKGROUND

Ramps and platforms are becoming increasingly common, due primarily to the recent passage of the Americans with Disabilities Act (ADA) requiring public buildings to be designed or modified to provide wheel chair access. These ramps and platforms assist those people confined to wheelchairs or who use walkers by providing a suitable pathway or rampway to the entrances of public and private buildings and stores, which may be at elevations above or below ground level. Since each site may be generally different from other sites, there is a need for ramp and platform assemblies that are modular in construction, and designed to minimize the cost and assembly time of at-site assembly.

Modular ramp and platform assemblies generally include deck surfaces, support posts, and handrails. These modular assemblies can be configured to provide ramping and horizontal deck surfaces to provide access, for example, if a user needs to travel from elevation A to elevation B, but is not able to traverse stairs or a steep slope to get there.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In accordance with aspects of the present disclosure, a support assembly is provided for a platform having an elevated deck and at least one handrail. The support assembly includes a handrail post that includes a connection interface configured to couple with the at least one handrail, a support post, and a connector configured to interface between the handrail post and the support post, the connector including one or more locking devices configured to conditionally lock the position of the handrail post and the support post with respect to the connector.

In accordance with another aspect of the present disclosure, a ramp and platform interface is provided. The interface includes a platform side defining one or more slots, the upper end of the one or more slots defined by a downwardly and inwardly extending lip, and at least one support flange each including a body, a lip disposed at the top edge of the body, and a flange section outwardly extending from the body. In some embodiments, the at least one support flange is selectively mounted to the platform side via the one or more slots. The interface also includes a ramp section that defines a support surface on a top side thereof and one or more support flange engagement structure on the bottom side thereof. In some embodiments, the ramp section is disposed in a supporting relationship with the platform side via cooperation of the flange section and the support flange engagement structure.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

The detailed description set forth below in connection with the appended drawings where like numerals reference like elements is intended as a description of various embodiments of the disclosed subject matter and is not intended to represent the only embodiments. Each embodiment described in this disclosure is provided merely as an example or illustration and should not be construed as preferred or advantageous over other embodiments. The illustrative examples provided herein are not intended to be exhaustive or to limit the claimed subject matter to the precise forms disclosed.

The following description sets forth one or more examples of a ramp and/or platform assembly and components thereof. Generally, embodiments described herein relate to modular ramp and platform assemblies that may include deck surfaces, support posts, and handrails. Additional embodiments relate to interfaces between components of the platform assembly, including, for example, the interface between the ramp section and the deck or platform section, the interface between the platform support posts and the handrail posts, etc.

As described in greater detail below, many of the components of the ramp and platform assembly may be formed from metal, for example, from extruded aluminum. Extruded aluminum construction generally reduces parts in the overall system, thereby reducing manufacturing and assembly costs, as well as operational noise generated by rattling part couplings. Moreover, extruded aluminum parts can be designed to achieve the same strength and stiffness requirements as steel construction, while having reduced weight over steel parts or parts made from other materials, allowing for improved ease of assembly and optimized part design.

In the following description, numerous specific details are set forth in order to provide a thorough understanding of exemplary embodiments of the present disclosure. It will be apparent to one skilled in the art, however, that many embodiments of the present disclosure may be practiced without some or all of the specific details. In some instances, well-known process steps have not been described in detail in order not to unnecessarily obscure various aspects of the present disclosure. It will be appreciated that embodiments of the present disclosure may employ any combination of features described herein.

Figure 1:
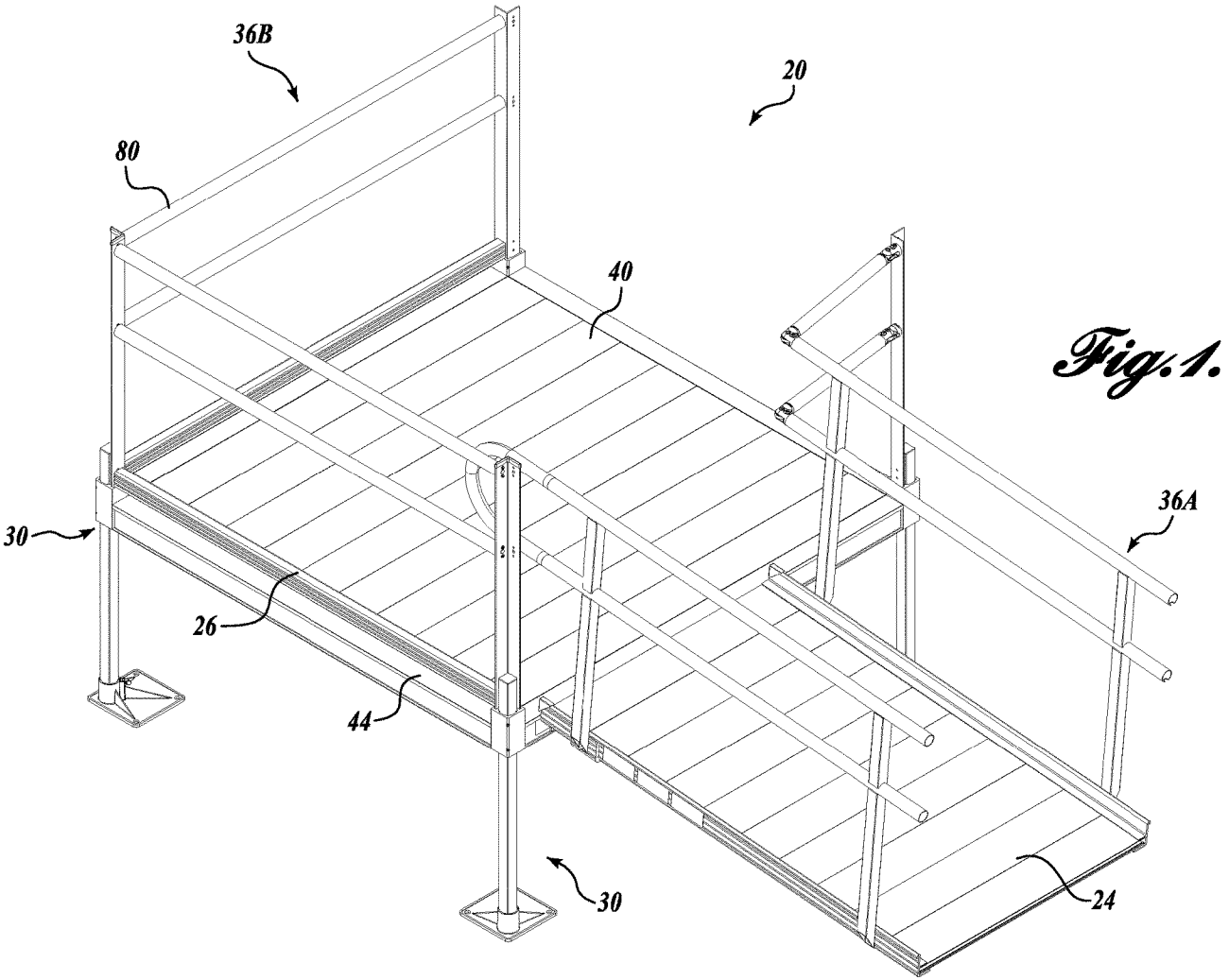
FIG. 1 is one example of a ramp and platform assembly in accordance with aspects of the present disclosure.

FIG. 1 illustrates an example of a modular ramp and platform assembly, generally designated 20, formed in accordance with aspects of the present disclosure. In the embodiment shown in FIG. 1, the assembly 20 includes a turn or an approximately 90 degree direction change for accessing an entrance/exit of a building (not shown). In that regard, the example of the assembly 20 depicted in FIG. 1 and described in detail below is assembled from one or more ramp sections 24 connected and supported by a "turn" platform 26 (hereinafter "platform 26"). The platform 26 is supported by a plurality of platform support posts or assemblies 30. The assembly 20 further includes a handrail 36 that extends around one or more sections of the perimeter of the assembly 20. In use, the assembly 20 spans from one surface (not shown) to a second, elevated surface (not shown), possibly over steps (not shown), for providing wheelchaired individuals and others a suitable pathway to an entrance of a building, such as a residential house, previously accessed by the steps.

In the embodiment shown, the handrail 36 is composed of an arrangement of ramp handrail sections 36A connected to the ramp sections 24 at the sides thereof, and platform handrail sections 36B connected to the platform 26 at the sides thereof. In some embodiments, the ramp handrail section 36A on the inside of the ramp section 24 with respect to the turn may be interconnected with the platform handrail 36B at the inside corner to form a continuous inside corner of the handrail 36.

Figure 2:
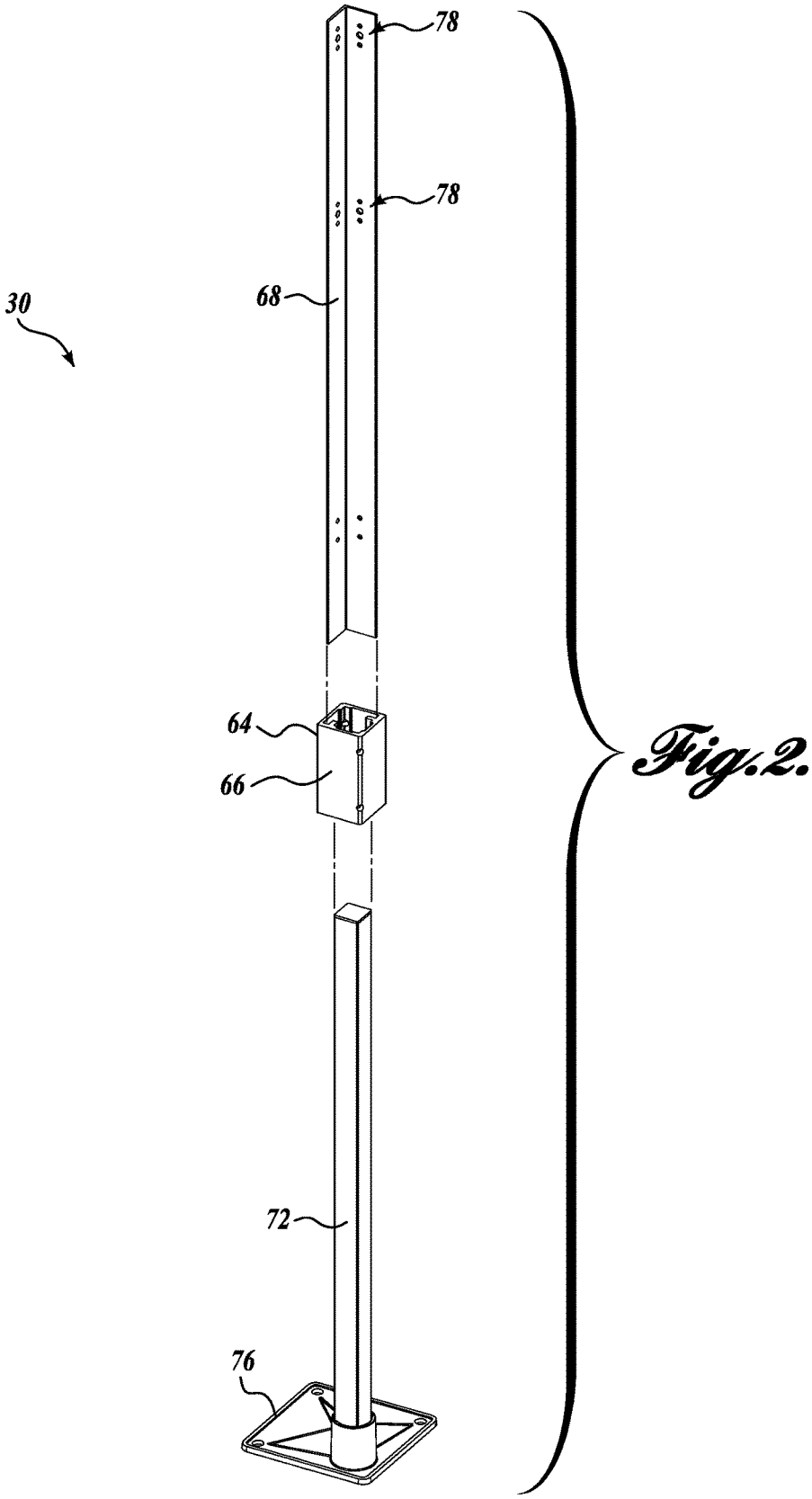
FIG. 2 is an exploded view of one example of a support post in accordance with aspects of the present disclosure.

Still referring to FIG. 1, the platform 26 will now be described in more detail. The platform 26 includes a substantially rectangular deck 40 and four side walls 44 that extend around the perimeter of the deck 40. The platform 26 is supported at its corners by a plurality of platform support assemblies 30. As best shown in FIG. 2, each platform support assembly 30 includes a connector 64. Generally described, the connector 64 has a rectangular tube-like body 66 and is configured to be fixedly secured to the sides 44 of the platform at the corners thereof (see FIG. 1). The connector 64 is configured to interface with, for example, an L-shaped handrail post 68 and, for example, a rectangular, tube-shaped support post 72. As will be described in more detail below, the connector 64 is configured to cooperatively receive both handrail post 68 and support post 72 in a sliding or telescoping manner in order to adjust the height of the platform 26 and/or the handrails 36, and can be fixedly secured to both handrail post 68 and support post 72. An optional footer 76 may be included for accepting one end of the support post 72 in a removably secure manner. In some embodiments, the handrail posts 68 may include one or more interfaces 78, such as apertures, brackets, and/or the like, configured for connection to one or more handrail members 80.

When the platform support assemblies 30 are assembled to support the platform 26, the connector 64 is positioned at the corners formed by sidewalls 44 and mounted thereto in a permanent or removable manner. In that regard, the connector 64 may include a connection interface, e.g., bolt holes, a mounting bracket, etc., configured to couple with the deck using appropriate fasteners. The support post 72 is routed through the connector 64 and is selectively coupled in a height adjustable manner to the connector 64. As such, the height of the platform 26 may be selectively adjusted for accommodating different installation applications and assembly sites. Similarly, the handrail post 68 is routed through the connector 64 and is selectively coupled in a height adjustable manner to the connector 64. As such, the height of the handrails may be selectively adjusted for accommodating different building codes, installation applications, and users.

Figure 3:
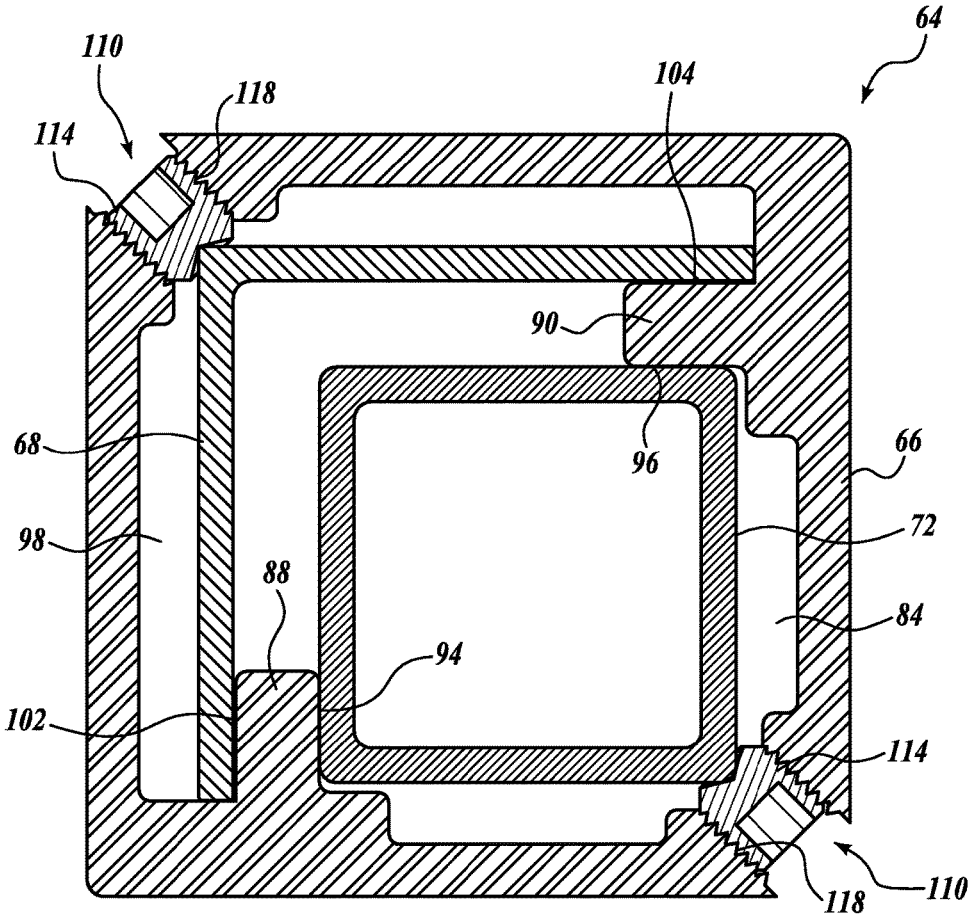
FIG. 3 is a horizontal cross-section of one example of a connector of the support post in accordance with aspects of the present disclosure.

Turning now to FIG. 3, there is shown a cross sectional view of one example of the connector 64 that may be practiced with embodiments of the present disclosure. As best shown in FIG. 3, the connector 64 includes a body 66 of generally rectangular cross section. The body 66 provides a first interior cavity section 84 configured to receive the support post 72. In the embodiment shown, the connector 64 includes interiorly extending flanges 88 and 90 mounted to or integrally formed with the body 66. The flanges 88 and 90 define first contact surfaces 94 and 96, respectively, which are oriented at right angles to one another. The first contact surfaces 94 and 96 are positioned and arranged so as to slidingly receive the support post 72.

The body 66 also provides a second interior cavity section 98 configured to receive the L-shaped handrail post 68. In the embodiment shown, the first and second flanges 88 and 90 define second contact surfaces 102 and 104, respectively, which are oriented at right angles to one another. The second contact surfaces 102 and 104 are positioned and arranged so as to slidingly receive the handrail post 68.

The connector 64 further includes first and second lock devices 110 disposed at diametrically opposed corners of the body 66. In the embodiment shown, the first and second lock devices 110 include thread pins 114 that threadably engage threaded bores 118. The thread pins 114 are sized and configured to interface with the corners of handrail post 68 and the support post 72, respectively, when such posts are received within the first and second cavity sections 84 and 98 of the body 66. In use, the thread pins 114 may be threadedly advanced inwardly toward the first interior cavity section 84 and the second interior cavity section 98 in order to contact the support post 72 and the handrail post 68, respectively, which, in turn, forces surfaces at the free end section of the handrail post 68 against second contact surfaces 102 and 104 and the free end section of the support post 68 against first contact surfaces 94 and 96. As such, selectively advancing the thread pins 114 can conditionally lock the posts 68 and 72 in place.

Figure 4:
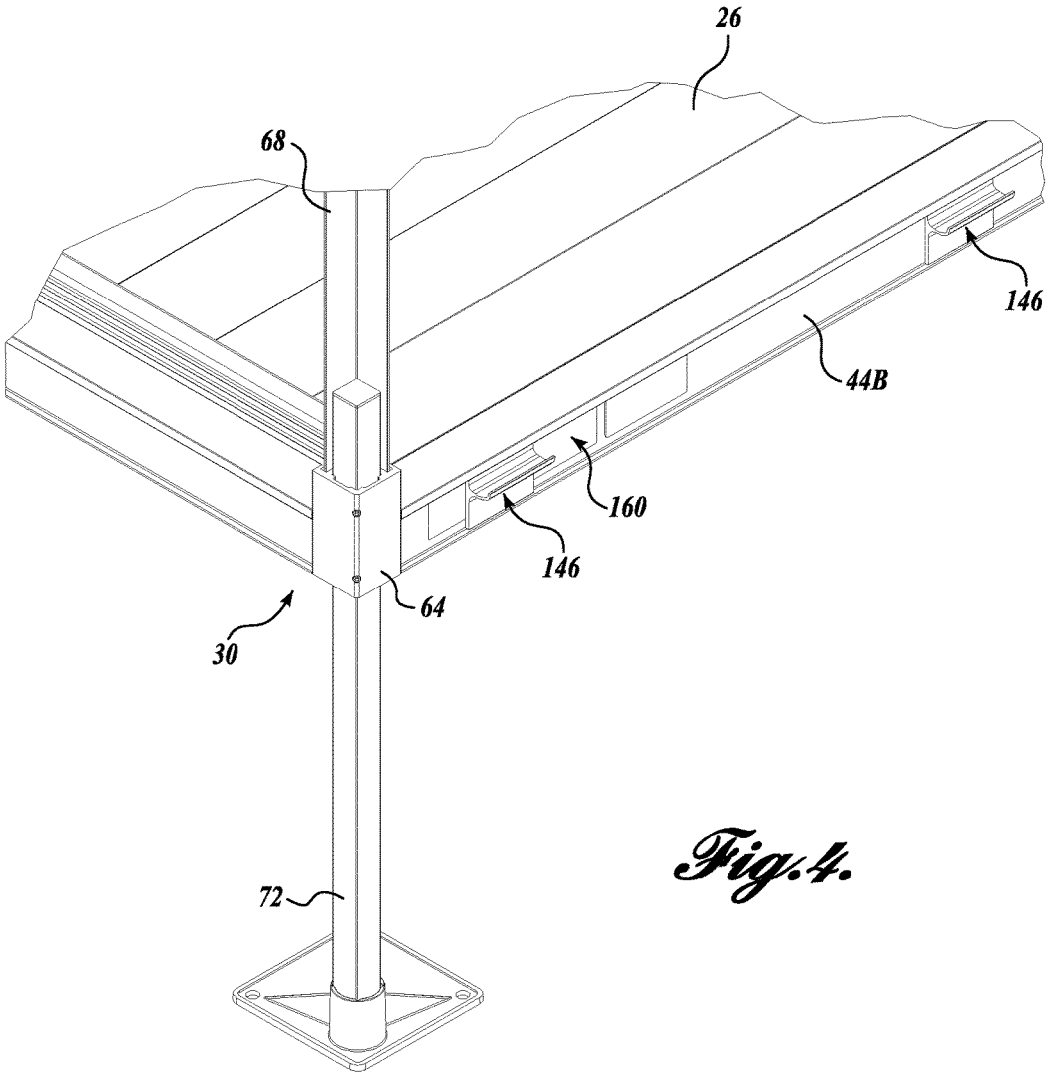
FIG. 4 is a partial perspective view detailing another aspect of the ramp and platform assembly.
Figure 5:
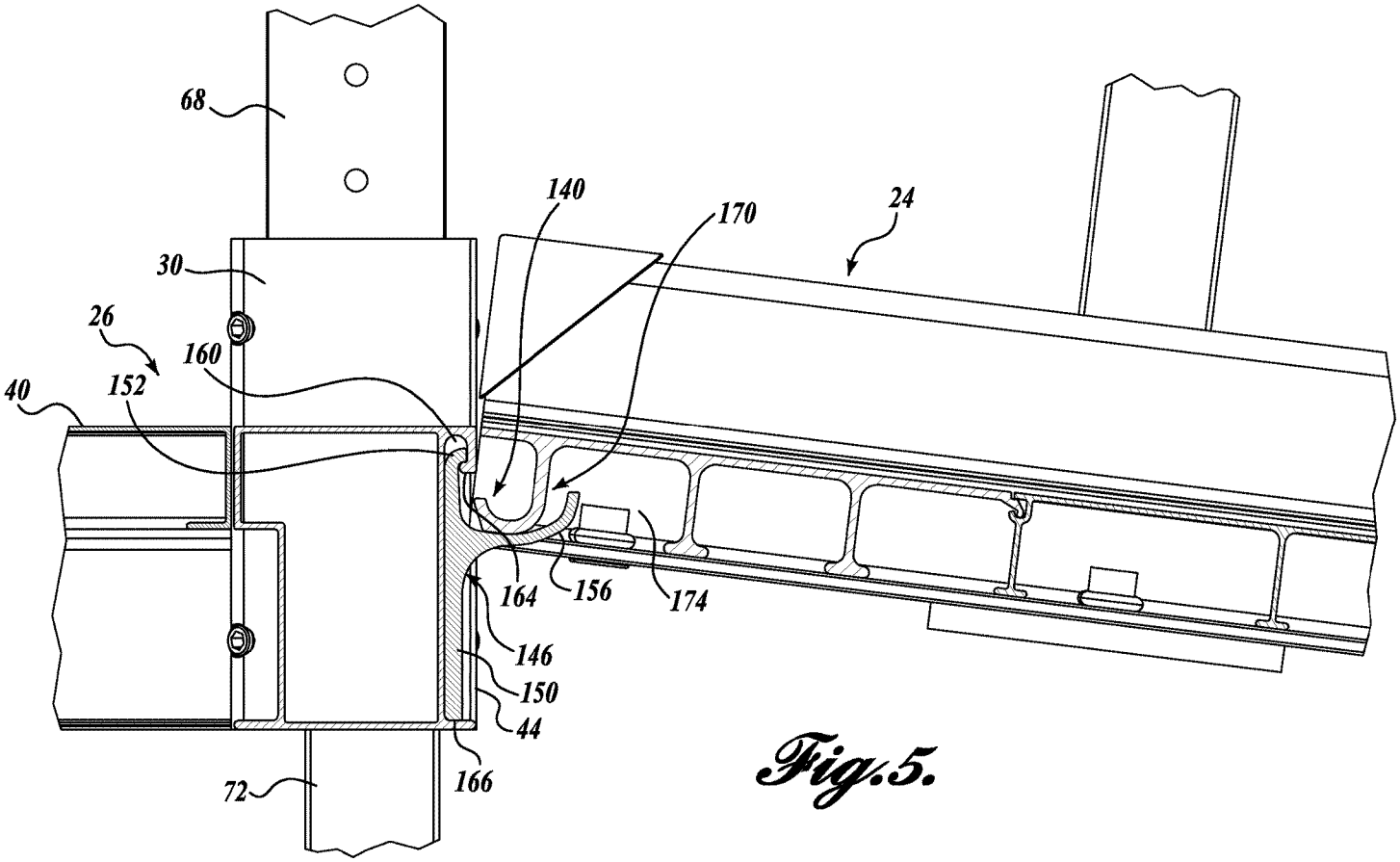
FIG. 5 is a partial cross-section view depicting one example of the interface between a ramp and a platform of the assembly of FIG. 1.

Another aspect of the present disclosure will now be described with reference to FIGS. 4 and 5. FIGS. 4 and 5 illustrate one example of an interface 140 between the ramp section 24 and the platform 26. As best shown in FIGS. 1 and 5, the upper end of the ramp section 24 is supported by the platform 26 via interface 140. In one embodiment, the interface 140 includes one or more support flanges 146 positioned along and extending outwardly from the side 44, such as side 44B, of the platform 26, as best shown in FIG. 4. The support flanges 146 can be integrally formed or selectively coupled to the sides 44 of the platform 26. Generally, the support flanges 146 are provided along a portion of the side 44 that corresponds in width to the ramp section 24.

In the embodiment shown in FIGS. 4 and 5, the support flanges 146 are distinct from the side 44 of the platform 26 and include a generally horizontally extending plate-like body 150. In some embodiments, the height of the plate-like body 150 generally corresponds to but is slightly shorter than the side 44 of platform 26. At the upper edge of the body 150 there is formed or otherwise mounted an outwardly and slightly downwardly curving lip 152. Extending outwardly and generally upwardly from the body 150 approximately mid height of the body 150 is a flange section 156.

To interface with the support flanges 146, the side 44B of the platform 26 includes either one contiguous slot 160 or a plurality of spaced apart slots. In either case, the upper end of the slot(s) 160 is formed by an inwardly extending lip 164, which is configured to cooperate with the lip 152 of each support flange body 152 in order to retain the support flange 146 therein. In particular, the slot 160 is generally sized to correspond in height with the support flange 146. To couple the support flange 146 with the slot 160, the support flange 146 can either be inserted from the side of the slot 160 or tilted into the slot 160 from a position facing the side 44. In either case, the lip 164 contacts the lip 152, thereby restricting the movement of the top of the support flange 146. Due to the corresponding height of the body 152, the bottom surface 166 of the body 150 is supported by the bottom of the slot 160 when the lips 152, 164 interact, thereby maintaining the position of the support flange 146 with respect to the side of the platform 26.

Once retained by the side 44*b*, the flange section 156 extends outwardly and upwardly from the body 150 in a generally arcuate manner. To interface with the flange section 156, the bottom of the ramp section 24 includes one or more laterally extending slots, apertures, or the like, generally designated 170. As such, structure 174 of the ramp section 24 adjacent the slots 170 is configured to rest against and be supported by the support flange section 156, as best shown in FIG. 5. Due to the interface configuration, the force exerted by the ramp section 24 on the flange section 156 aids in maintaining the support flange 146 in place with respect to the slot 160.

The principles, representative embodiments, and modes of operation of the present disclosure have been described in the foregoing description. However, aspects of the present disclosure which are intended to be protected are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure, as claimed.

The embodiments of the invention in which an exclusive property or privilege is claimed are defined as follows:

1. A support assembly for a platform having an elevated deck and at least one handrail, comprising:

a handrail post that includes a connection interface configured to couple with the at least one handrail;

a support post; and a connector having a first receiving end and a second receiving end, the connector configured to cooperatively receive both the handrail post and the support post in a sliding manner, wherein the connector includes first and second interiorly extending flanges that cooperate to define at least parts of first and second distinct cavity sections, each flange including a first contact surface in the first cavity section and a second contact surface in the second cavity section, wherein the entire first contact surface of the first flange is parallel to and facing away from the entire second contact surface of the first flange and wherein the entire first contact surface of the second flange is parallel to and facing away from the entire second contact surface of the second flange, wherein both the first and second distinct cavity sections extend along the length of the connector from the first receiving end to the second receiving end, wherein the first and second distinct cavity sections are configured to receive the handrail post and the support post, the handrail post in contact with the first contact surfaces on the first and second flanges, wherein the first contact surfaces on the first and second flanges are perpendicular to each other, and the support post in contact with the second contact surfaces on the first and second flanges, respectively, and to allow sliding movement with respect to one another in an overlapping manner, the connector including a plurality of locking devices configured to conditionally lock the connector at any position along the length of the handrail post and independently at any position along the length of the support post.

2. The support assembly of claim 1, wherein the plurality of locking devices include a first thread pin that is selectively movable into the first cavity section and a second thread pin that is selectively movable into the second cavity section.

3. The support assembly of claim 2, wherein the connector is generally rectangular in cross section and the first and second thread pins are positioned at diametrically opposed corners of the connector.

4. The support assembly of claim 3, wherein the locking devices further include first and second threaded bores disposed in the connector, the first and second threaded bores configured to cooperate with the respective first and second thread pins of the locking devices.

5. The support assembly of claim 1, wherein the handrail post is generally L-shaped in cross section.

6. The support assembly of claim 1, wherein the support post includes rectangular tubing.

7. The support assembly of claim 1, wherein the connector includes a connection interface configured to couple with the deck in a supporting manner.

8. A support assembly for a platform having an elevated deck and at least one handrail, comprising:

a handrail post that includes a connection interface configured to couple with the at least one handrail, wherein the handrail post is generally L-shaped in cross section having first and second sides;

a support post, wherein the support post includes rectangular tubing having at least first and second sides; and a connector having a first receiving end and a second receiving end, the connector configured to cooperatively receive the handrail post and the support post in a sliding manner, wherein the connector includes first and second interiorly extending flanges that cooperate to define at least parts of first and second distinct cavity sections, each flange including a first contact surface in the first cavity section and a second contact surface in the second cavity section, wherein the first contact surface of the first flange is parallel to the second contact surface of the first flange and wherein the first contact surface of the second flange is parallel to and opposed from the second contact surface of the second flange such that the first side of the support post is parallel to and opposed from the first side of the handrail post and the second side of the support post is parallel to the second side of the handrail post, wherein both the first and second distinct cavity sections extend along the length of the connector from the first receiving end to the second receiving end, wherein the first and second distinct cavity sections are configured to receive the handrail post and the support post, the handrail post in contact with the first contact surfaces on the first and second flanges, wherein the first contact surfaces on the first and second flanges are perpendicular to each other, and the support post in contact with the second contact surfaces on the first and second flanges, respectively, and to allow sliding movement with respect to one another in an overlapping manner, the connector including a plurality of locking devices configured to conditionally lock the connector at any position along the length of the handrail post and independently at any position along the length of the support post.

9. A support assembly for a platform having an elevated deck and at least one handrail, comprising:

a handrail post that includes a connection interface configured to couple with the at least one handrail;

a support post; and a connector having a first receiving end and a second receiving end, the connector configured to cooperatively receive both the handrail post and the support post in a sliding manner, wherein the connector includes first and second interiorly extending flanges that cooperate to define at least parts of first and second distinct cavity sections, each flange including a first contact surface in the first cavity section and a second contact surface in the second cavity section, wherein the entire first contact surface of the first flange is facing away from the entire second contact surface of the first flange and wherein the entire first contact surface of the second flange is facing away from the entire second contact surface of the second flange, wherein both the first and second distinct cavity sections extend along the length of the connector from the first receiving end to the second receiving end, wherein the first and second distinct cavity sections are configured to receive the handrail post and the support post, the handrail post in contact with the first contact surfaces on the first and second flanges, wherein the first contact surface on the first and second flanges are perpendicular to each other, and the support post in contact with the second contact surfaces on the first and second flanges, respectively, and to allow sliding movement with respect to one another in an overlapping manner, the connector including a plurality of locking devices configured to conditionally lock the connector at any position along the length of the handrail post and independently at any position along the length of the support post.

* * * * *